US012767469B2

(12) United States Patent
Yamamoto et al.

(10) Patent No.: US 12,767,469 B2
(45) Date of Patent: Oct. 20, 2026

(54) SHEET CONVEYING DEVICE AND IMAGE FORMING APPARATUS

(71) Applicant: KYOCERA Document Solutions Inc., Osaka (JP)

(72) Inventors: Takenori Yamamoto, Osaka (JP); Masakazu Yamamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 19 days.

(21) Appl. No.: 19/218,071

(22) Filed: May 23, 2025

(65) Prior Publication Data

US 2025/0360734 A1 Nov. 27, 2025

(30) Foreign Application Priority Data

May 24, 2024 (JP) ..... 2024-084701

(51) Int. Cl.
*B65H 9/16* (2006.01)
*B65H 7/10* (2006.01)
*B65H 7/14* (2006.01)

(52) U.S. Cl.
CPC ..... *B65H 9/166* (2013.01); *B65H 7/10* (2013.01); *B65H 7/14* (2013.01); *B65H 2404/7414* (2013.01); *B65H 2553/416* (2013.01)

(58) Field of Classification Search
CPC .. B65H 2404/7414; B65H 7/10; B65H 9/166; B65H 2701/1315
See application file for complete search history.

(56) References Cited

U.S. PATENT DOCUMENTS 7,404,557 B2 * 7/2008 Tada ..... B65H 9/166 271/226
8,746,693 B2 * 6/2014 Miyazawa ..... B65H 9/163 271/227
2004/0188929 A1 * 9/2004 Tada ..... B65H 9/166 271/248
2008/0024582 A1 1/2008 Yokoyama
2023/0009594 A1 * 1/2023 Shmaiser ..... B65H 5/062
2023/0017154 A1 * 1/2023 Inui ..... B65H 5/36

FOREIGN PATENT DOCUMENTS

JP 2008030412 A 2/2008
JP 2023013615 A * 1/2023 ..... B65H 9/166

* cited by examiner

*Primary Examiner* — Patrick Cicchino
(74) *Attorney, Agent, or Firm* — Alleman Hall LLP

(57) ABSTRACT

A first conveying mechanism conveys a sheet. A correction member is provided more on an upstream side of a conveying direction of the sheet than the first conveying mechanism, and includes a contact surface that comes into contact with a side end of the sheet at one end of a conveying path of the sheet in a width direction. A first orientation adjustment mechanism is operated by being input with a drive signal and changes an angle of the contact surface. A second conveying mechanism is provided more on the upstream side of the conveying direction than the correction member, and conveys the sheet toward the contact surface along a direction oblique with respect to the conveying direction. A support member supports the correction member and the first orientation adjustment mechanism. A second orientation adjustment mechanism is capable of changing an orientation of the support member by being operated manually.

7 Claims, 7 Drawing Sheets

SHEET CONVEYING DEVICE AND IMAGE FORMING APPARATUS

INCORPORATION BY REFERENCE

This application is based upon and claims the benefit of priority from the corresponding Japanese Patent Application No. 2024-084701 filed on May 24, 2024, the entire contents of which are incorporated herein by reference.

BACKGROUND

The present disclosure relates to a sheet conveying device including a mechanism which corrects a tilt of a sheet and an image forming apparatus.

An image forming apparatus is known to include a mechanism which corrects a tilt of a sheet conveyed toward an image forming portion.

For example, it is known that the tilt of a sheet is corrected by conveying the sheet to a nip portion of a registration roller pair that has temporarily been stopped.

SUMMARY

A sheet conveying device according to an aspect of the present disclosure includes a first conveying mechanism, a correction member, a first orientation adjustment mechanism, a second conveying mechanism, a support member, and a second orientation adjustment mechanism. The first conveying mechanism conveys a sheet. The correction member is provided more on an upstream side of a conveying direction of the sheet by the first conveying mechanism than the first conveying mechanism, and includes a contact surface that comes into contact with a side end of the sheet at one end of a conveying path of the sheet in a width direction orthogonal to the conveying direction. The first orientation adjustment mechanism is operated by being input with a drive signal and changes an angle of the contact surface with respect to the conveying direction. The second conveying mechanism is provided more on the upstream side of the conveying direction than the correction member, and conveys the sheet toward the contact surface along a direction that is oblique with respect to the conveying direction. The support member supports the correction member and the first orientation adjustment mechanism. The second orientation adjustment mechanism is capable of changing an orientation of the support member with respect to the conveying direction by being operated manually.

An image forming apparatus according to another aspect of the present disclosure includes the sheet conveying device, an image forming portion, an image reading device, an image processing portion, and an adjustment processing portion. The image forming portion forms an image on the sheet conveyed by the first conveying mechanism. The image reading device reads an outer shape of the sheet conveyed by the sheet conveying device. The image processing portion derives, based on a read image obtained by the image reading device, a tilt angle of the sheet with respect to the conveying direction. The adjustment processing portion outputs the drive signal to the first orientation adjustment mechanism based on a derived result of the tilt angle.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
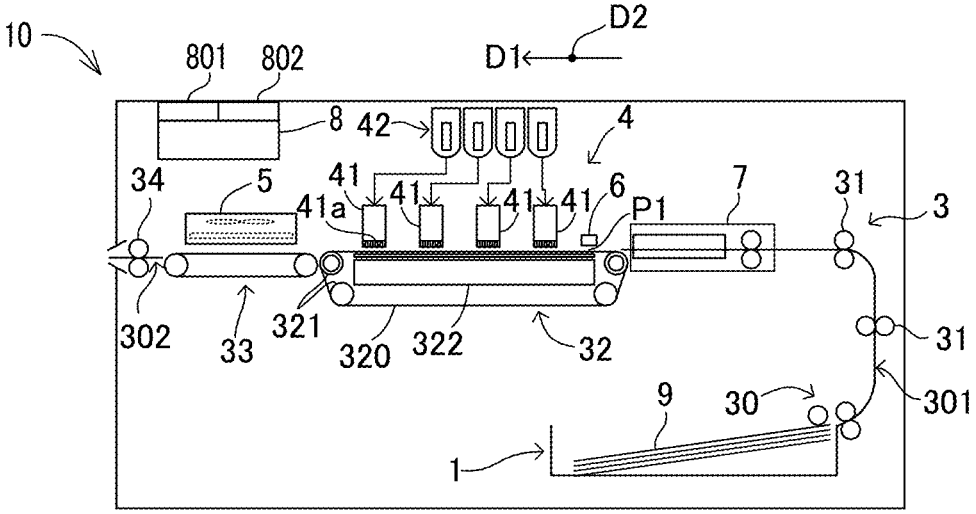
FIG. 1 is a configuration diagram of an image forming apparatus according to an embodiment of the present disclosure.

Hereinafter, an embodiment of the present disclosure will be described with reference to the attached drawings. It is noted that the following embodiment is an example of embodying the present disclosure and does not limit the technical scope of the present disclosure.

[Configuration of Image Forming Apparatus 10]

An image forming apparatus 10 according to the embodiment of the present disclosure includes a sheet storing portion 1, a sheet conveying device 3, and a printing device 4. The image forming apparatus 10 further includes a drying device 5, an operation device 801, a display device 802, a control device 8, and the like.

The sheet conveying device 3 includes a sheet feed mechanism 30, a plurality of conveying roller pairs 31, a first belt conveying device 32, a second belt conveying device 33, and a discharge roller pair 34. The sheet conveying device 3 further includes a tilt correction mechanism 7.

The sheet feed mechanism 30 feeds a sheet 9 stored in the sheet storing portion 1 to a first conveying path 301. The plurality of conveying roller pairs 31 convey the sheet 9 along the first conveying path 301, and further sends the sheet 9 to the tilt correction mechanism 7.

The tilt correction mechanism 7 is arranged to precede the first belt conveying device 32 on the first conveying path 301. The tilt correction mechanism 7 sends the sheet 9 from the first conveying path 301 to the first belt conveying device 32 while correcting a tilt of the sheet 9.

The first belt conveying device 32 takes over from the tilt correction mechanism 7 to convey the sheet 9, and sends the sheet 9 to the second belt conveying device 33. The first belt conveying device 32 includes an annular conveying belt 320, a plurality of support rollers 321, and a suction device 322.

The plurality of support rollers 321 rotatably support the conveying belt 320. A belt drive motor (not shown) rotates one of the plurality of support rollers 321 to thus rotate the conveying belt 320.

Figure 3:
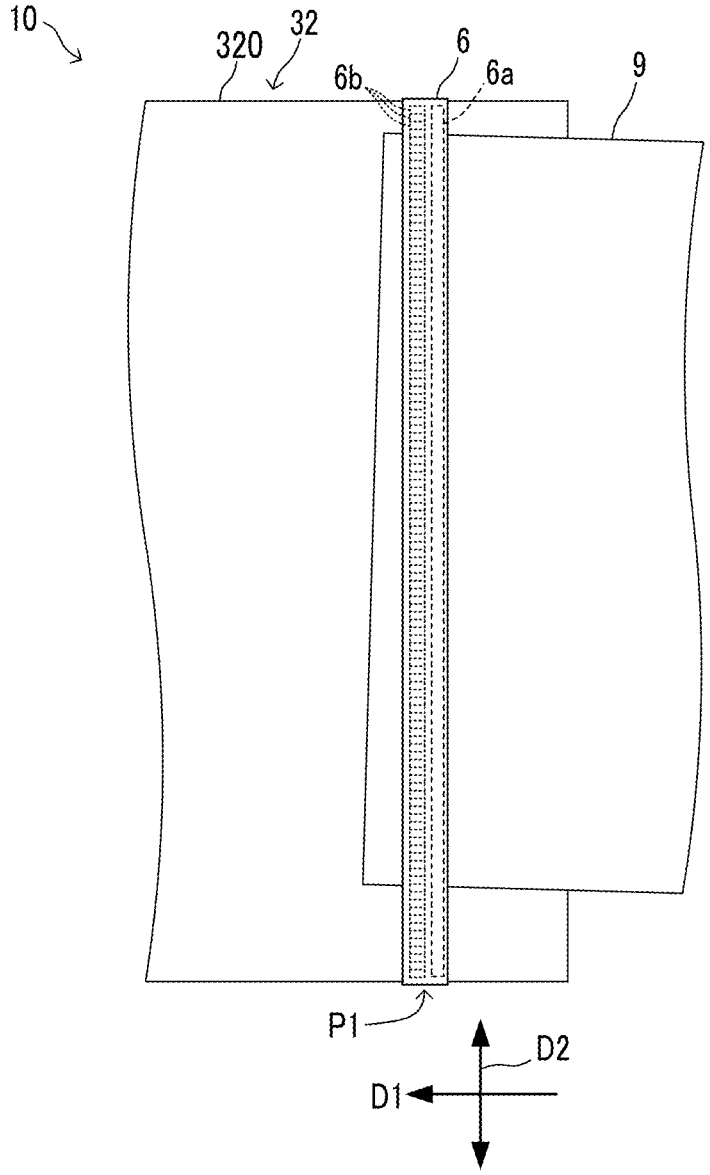
FIG. 3 is a plan view showing configurations of a conveying belt and a line sensor in the image forming apparatus according to the embodiment of the present disclosure.
Figure 4:
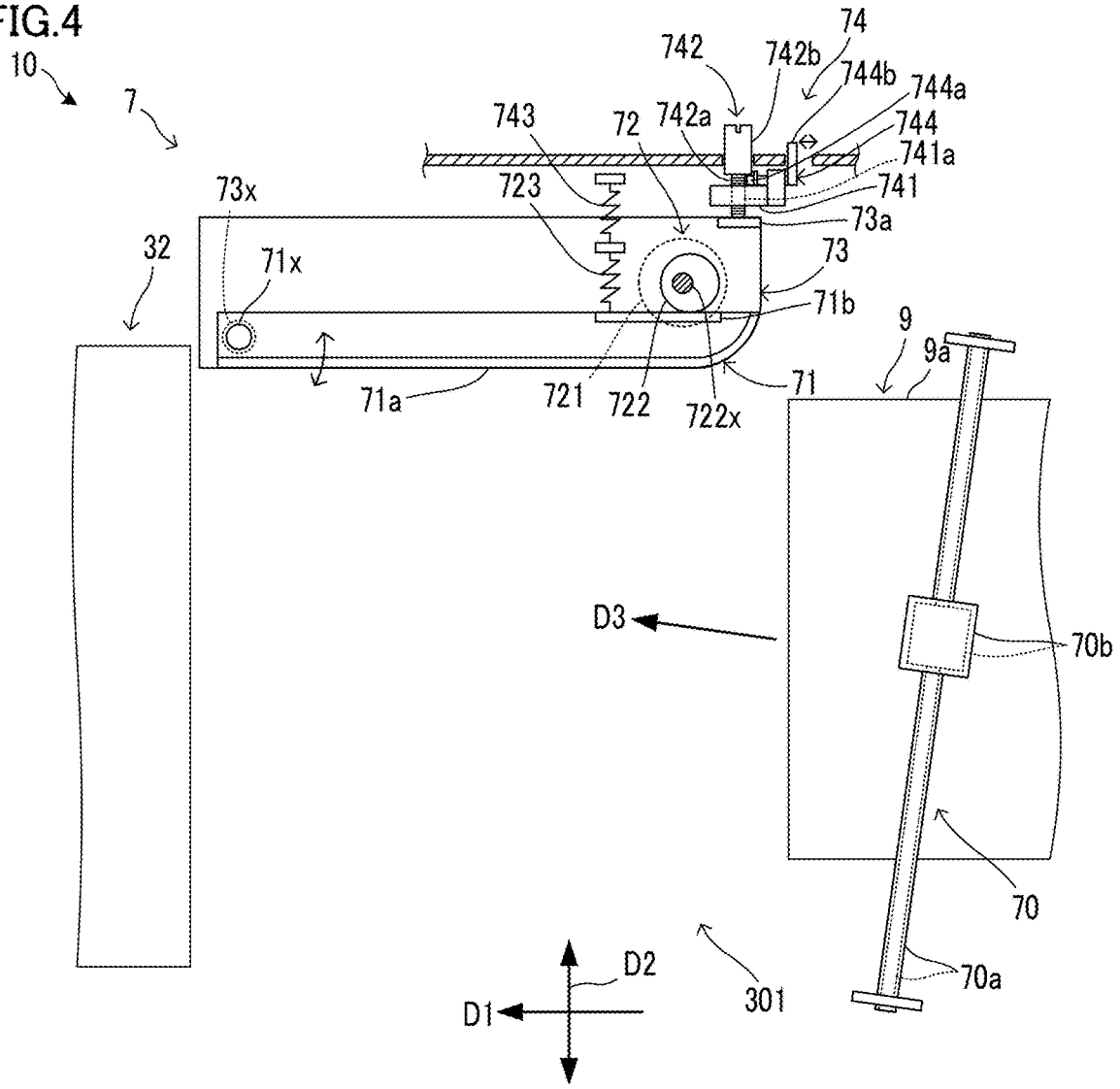
FIG. 4 is a plan view showing a configuration of a tilt correction mechanism in the image forming apparatus according to the embodiment of the present disclosure.

The tilt correction mechanism 7 conveys the sheet 9 onto an upper surface of the conveying belt 320. The first belt conveying device 32 conveys the sheet 9 delivered onto the upper surface of the conveying belt 320 by the rotating conveying belt 320. In FIG. 1, FIG. 3, and FIG. 4, a first direction D1 is a conveying direction of the sheet 9 by the first belt conveying device 32. As the conveying belt 320 rotates, the upper surface of the conveying belt 320 moves in the first direction D1.

The tilt correction mechanism 7 is arranged more on an upstream side of the first direction D1 than the first belt conveying device 32.

The suction device 322 causes the sheet 9 to adhere to the upper surface of the conveying belt 320 by sucking in air.

The second belt conveying device 33 takes over from the first belt conveying device 32 to convey the sheet 9, and further sends the sheet 9 to a second conveying path 302.

The discharge roller pair 34 conveys the sheet 9 along the second conveying path 302, and further sends the sheet 9 from the second conveying path 302 to a subsequent portion. For example, the subsequent portion is a discharge tray, a post-processing device, or the like.

The printing device 4 executes print processing on the sheet 9 conveyed by the conveying belt 320 of the first belt conveying device 32. The print processing is processing of forming an image on the sheet 9.

In the present embodiment, the printing device 4 executes the print processing by an inkjet method. That is, the printing device 4 forms an image on the sheet 9 by ejecting ink onto the sheet 9. The ink is an example of developer. The printing device 4 is an example of an image forming portion which forms an image on the sheet 9.

The printing device 4 includes a plurality of ink heads 41 and a plurality of ink supply portions 42 that respectively correspond to different colors of ink. Specifically, the printing device 4 includes four ink heads 41 and four ink supply portions 42 that respectively correspond to yellow, magenta, cyan, and black.

The plurality of ink heads 41 each include a plurality of ejection nozzles 41*a* for ejecting ink. The plurality of ink heads 41 are fixed at positions that oppose the surface of the conveying belt 320 of the first belt conveying device 32. The plurality of ink supply portions 42 respectively store the different colors of ink and respectively supply the ink to the plurality of ink heads 41.

The drying device 5 dries an ink image formed on the sheet 9 by blowing hot air onto the sheet 9 conveyed by the second belt conveying device 33.

In FIG. 1, FIG. 3, and FIG. 4, a second direction D2 is a direction that intersects with the first direction D1. In the present embodiment, the second direction D2 is a width direction orthogonal to the first direction D1. The second direction D2 is a main scanning direction in the print processing, and a direction along the first direction D1 is a sub-scanning direction in the print processing.

The operation device 801 detects operations by a person. For example, the operation device 801 includes a plurality of operation buttons and a touch panel. The display device 802 is capable of displaying various types of information. For example, the display device 802 is a panel display device such as a liquid crystal display panel.

Figure 2:
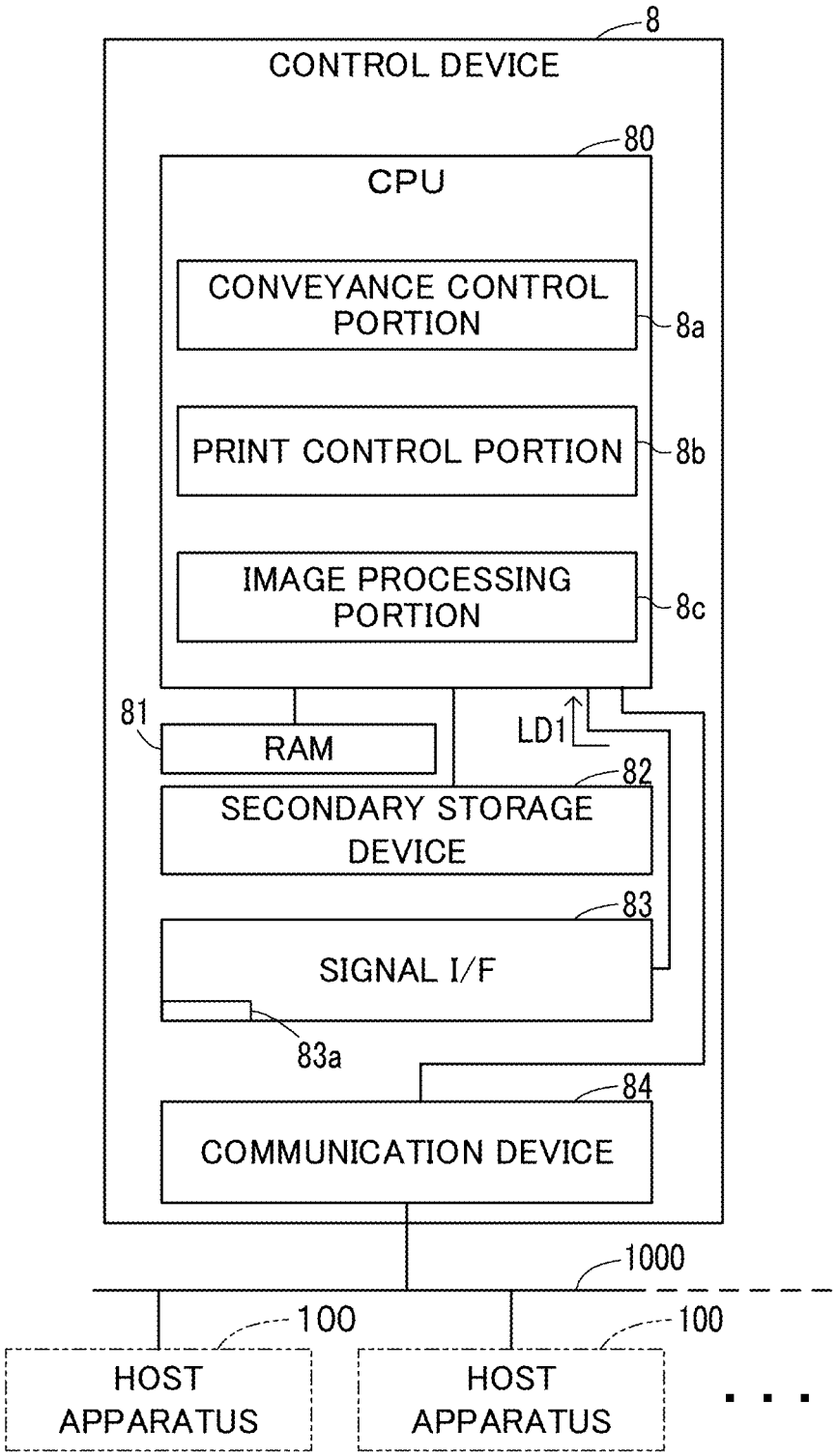
FIG. 2 is a block diagram showing a configuration of a control device in the image forming apparatus according to the embodiment of the present disclosure.

As shown in FIG. 2, the control device 8 includes a CPU (Central Processing Unit) 80, a RAM (Random Access Memory) 81, a secondary storage device 82, a signal interface 83, a communication device 84, and the like.

The CPU 80 executes various types of control and data processing by executing computer programs. The RAM 81 temporarily stores the computer programs to be executed by the CPU 80 and various types of data.

The secondary storage device 82 is a computer-readable nonvolatile storage device. The secondary storage device 82 stores the computer programs to be executed by the CPU 80 and various types of data. For example, one or both of a flash memory and a hard disk drive is/are adopted as the secondary storage device 82.

The signal interface 83 converts detection signals from various sensors into digital detection data, and transmits the detection data to the CPU 80. Furthermore, the signal interface 83 converts control commands output from the CPU 80 into control signals, and transmits the control signals to devices to be controlled.

The communication device 84 executes communication with other apparatuses such as a host apparatus 100 via a network 1000. The CPU 80 executes communication with other apparatuses via the communication device 84. The host apparatus 100 is an information processing apparatus which requests the image forming apparatus 10 to execute the print processing.

The CPU 80 includes a plurality of processing modules that are realized by executing the computer programs. The plurality of processing modules include a conveyance control portion 8*a*, a print control portion 8*b*, and the like (see FIG. 2).

The conveyance control portion 8*a* controls the sheet conveying device 3 to control conveyance of the sheet 9. The print control portion 8*b* causes the printing device 4 to execute the print processing in sync with the conveyance of the sheet 9. Furthermore, when the print processing is executed, the print control portion 8*b* causes the drying device 5 to operate.

It is noted that some or all of the processing executed by the CPU 80 may be executed by a DSP (Digital Signal Processor), an SoC (System on a Chip), or the like. Each of the CPU 80, the DSP, and the SoC is an example of a processor.

Incidentally, in the image forming apparatus 10, in order to improve image quality, it is required to correct the tilt of the sheet 9 with more certainty.

Figure 7:
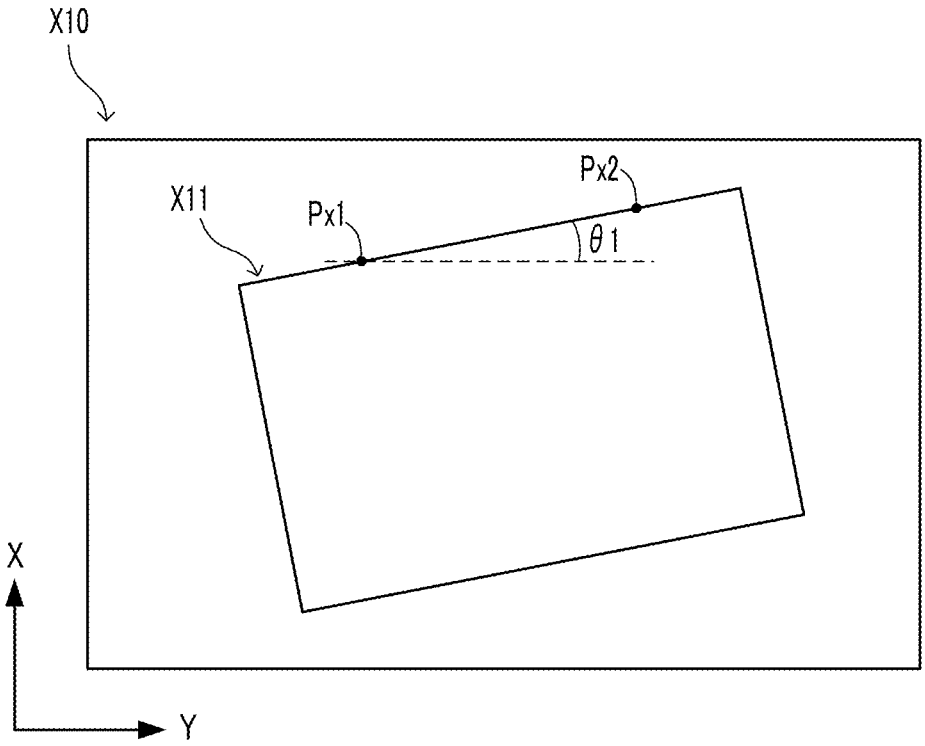
FIG. 7 is a diagram showing an example of image data used in first tilt derivation processing executed in the image forming apparatus according to the embodiment of the present disclosure.

For example, it is required to detect a tilt angle θ1 of the conveyed sheet 9 and correct the tilt of the sheet 9 with more certainty in accordance with a detection result of the tilt angle θ1 (see FIG. 7).

In the present embodiment, the image forming apparatus 10 further includes a line sensor 6 (see FIG. 1 and FIG. 3). The line sensor 6 is arranged at a specific position P1 along the upper surface of the conveying belt 320 in the first belt conveying device 32. The line sensor 6 is arranged along the second direction D2 (see FIG. 3).

The specific position P1 is a position that is more on the upstream side of the first direction D1 than the plurality of ink heads 41 of the printing device 4. The line sensor 6 is an image sensor that reads an image of an area along the second direction D2 at the specific position P1.

The line sensor 6 includes a light-emitting portion 6*a* and a plurality of photoelectric conversion elements 6*b* (see FIG. 3). The light-emitting portion 6*a* irradiates light onto a linear area provided along the second direction D2 on the surface of the conveying belt 320. The plurality of photoelectric conversion elements 6*b* are arrayed along the second direction D2.

The plurality of photoelectric conversion elements 6*b* each detect an amount of light that has been diffusely reflected on the surface of the conveying belt 320, and output a plurality of pixel signals each indicating the detected amount of light. The signal interface 83 includes an AFE (Analog Front End) 83*a* that converts the plurality of pixel signals sequentially output by the line sensor 6 into a plurality of pieces of pixel data (see FIG. 2).

The plurality of pieces of pixel data of a plurality of lines that are output from the AFE 83*a* are transmitted to the CPU 80 as a plurality of pieces of line image data LD1 (see FIG. 2).

By the line sensor 6 operating when the sheet 9 passes through the specific position P1, the plurality of pieces of line image data LD1 are obtained. The plurality of pieces of line image data LD1 are image data X10 expressing a sheet outer shape image X11 (see FIG. 7).

The sheet outer shape image X11 is an image of an outer shape of the sheet 9 conveyed by the first belt conveying device 32. The image data X10 is used to derive the tilt angle θ1 of the sheet 9 that passes through the specific position P1 (see FIG. 7).

The line sensor 6 is an example of an image reading device which reads the outer shape of the sheet 9 conveyed by the first belt conveying device 32 of the sheet conveying device 3. The image data X10 is data of a read image obtained by the line sensor 6.

In the present embodiment, the plurality of processing modules include an image processing portion 8*c* which processes the image data X10 to derive the tilt angle θ1 of the sheet 9. The tilt correction mechanism 7 operates in accordance with the derived tilt angle θ1.

It is desirable for the tilt correction mechanism 7 which corrects the tilt of the sheet 9 to be realized with a simple mechanism. Hereinafter, a configuration of the tilt correction mechanism 7 will be described.

[Tilt Correction Mechanism 7]

The tilt correction mechanism 7 includes an oblique conveying mechanism 70, a correction member 71, a first orientation adjustment mechanism 72, a support member 73, and a second orientation adjustment mechanism 74 (see FIG. 4).

The correction member 71 is provided more on the upstream side of the first direction D1 than the first belt conveying device 32. The correction member 71 includes a contact surface 71*a* that comes into contact with a side end 9*a* of the sheet 9 at one end of the first conveying path 301 in the second direction D2. The contact surface 71*a* is a surface that guides the side end 9*a* of the sheet 9 along the first direction D1.

The oblique conveying mechanism 70 is provided more on the upstream side of the first direction D1 than the correction member 71. The oblique conveying mechanism 70 conveys the sheet toward the contact surface 71*a* along a third direction D3 oblique to the first direction D1.

In the example shown in FIG. 4, the oblique conveying mechanism 70 includes a pair of rotation shafts 70*a* arranged obliquely with respect to the second direction D2, and a roller pair 70*b* supported by the pair of rotation shafts 70*a*.

The correction member 71 is supported so as to be rotatable about a first shaft portion 71*x* along the second direction D2 (see FIG. 4). By the correction member 71 rotating, an angle of the contact surface 71*a* with respect to the first direction D1 changes.

It is noted that the first belt conveying device 32 is an example of a first conveying mechanism which conveys the sheet 9 in the first direction D1. The oblique conveying mechanism 70 is an example of a second conveying mechanism which conveys the sheet 9 toward the contact surface 71*a*.

The first orientation adjustment mechanism 72 is operated by being input with a drive signal, and changes the angle of the contact surface 71*a* with respect to the first direction D1. In the present embodiment, the first orientation adjustment mechanism 72 is a mechanism which causes the correction member 71 to rotate about the first shaft portion 71*x*. The drive signal is output from the control device 8 to the first orientation adjustment mechanism 72.

For example, the first orientation adjustment mechanism 72 includes a control motor 721, a cam 722, and a spring 723 (see FIG. 4).

By being input with the drive signal, the control motor 721 rotates in a first rotation direction or a second rotation direction. For example, the control motor 721 is a stepping motor, a servo motor, or the like. The control motor 721 operates in accordance with the drive signal and causes the cam 722 to rotate about a rotation shaft 722*x*.

The cam 722 rotates while being in contact with a to-be-in-contact portion 71*b* of the correction member 71, to thus cause the correction member 71 to swing about the first shaft portion 71*x*. By the swing of the correction member 71, the angle of the contact surface 71*a* with respect to the first direction D1 changes.

The spring 723 biases the correction member 71 toward the cam 722 so as to maintain a state where the cam 722 is in contact with the to-be-in-contact portion 71*b* of the correction member 71.

The support member 73 supports the correction member 71 and the first orientation adjustment mechanism 72. The support member 73 is supported so as to be rotatable about a second shaft portion 73*x* along the second direction D2 (see FIG. 4).

By the rotation of the support member 73, an orientation of the support member 73 with respect to the first direction D1 changes. Therefore, by the rotation of the support member 73, the angle of the contact surface 71*a* with respect to the first direction D1 changes.

The correction member 71 and the support member 73 are members that are arranged independently of the first belt conveying device 32. In other words, the correction member 71 and the support member 73 are each capable of rotating in a state where the first belt conveying device 32 is fixed in a certain orientation.

The second orientation adjustment mechanism 74 is capable of changing the orientation of the support member 73 with respect to the first direction D1 by being operated manually. In the present embodiment, the second orientation adjustment mechanism 74 is a mechanism which causes the support member 73 to rotate about the second shaft portion 73*x*.

For example, the second orientation adjustment mechanism 74 includes a base portion 741, a screw member 742, and a spring 743 (see FIG. 4).

The base portion 741 is fixed at a predetermined position. The base portion 741 is formed with a screw hole 741*a*.

The screw member 742 is fastened to the screw hole 741*a* of the base portion 741. The screw member 742 includes a screw shaft 742*a* fastened to the screw hole 741*a* and a head portion 742*b* coupled to a base end portion of the screw shaft 742*a* (see FIG. 4).

A tip end portion of the screw shaft 742*a* is abutted against a to-be-in-contact portion 73*a* of the support member 73. The spring 743 biases the support member 73 toward the screw member 742, to thus maintain a state where the tip end portion of the screw member 742 is abutted against the to-be-in-contact portion 73*a* of the support member 73.

By the screw member 742 receiving the manual operation of rotating the head portion 742*b*, a fastening depth of the screw member 742 with respect to the screw hole 741*a* changes, and also the support member 73 rotates about the second shaft portion 73*x*.

By the support member 73 rotating about the second shaft portion 73*x*, the orientation of the support member 73 with respect to the first direction D1 changes.

In the present embodiment, the second shaft portion 73*x* is arranged coaxially with the first shaft portion 71*x*. Thus, a sum of an adjustment angle by the first orientation adjustment mechanism 72 and an adjustment angle by the second orientation adjustment mechanism 74 is an adjustment angle of the contact surface 71*a*.

In the example shown in FIG. 4, the second orientation adjustment mechanism 74 further includes a screw restriction member 744. The screw restriction member 744 includes an insertion portion 744*a* and a knob portion 744*b*. The insertion portion 744*a* is a portion that is inserted between the head portion 742*b* of the screw member 742 and the base portion 741. The knob portion 744*b* is a portion that is operated by a person.

The screw restriction member 744 moves from one of a restriction position and an evacuation position to the other by a force received by the knob portion 744*b*. When the screw restriction member 744 is positioned at the restriction position, the insertion portion 744*a* is positioned between the head portion 742*b* and the base portion 741. When the screw restriction member 744 is positioned at the evacuation position, the insertion portion 744*a* is positioned away from the position between the head portion 742*b* and the base portion 741.

In a state where the screw restriction member 744 is positioned at the restriction position, the screw member 742 is fastened at a reference depth at which the insertion portion 744*a* is sandwiched between the screw member 742 and the base portion 741. Thus, the support member 73 is positioned at a predetermined reference position.

When the screw member 742 is fastened deeper into the screw hole 741*a* than the reference depth, the screw restriction member 744 is moved in advance from the restriction position to the evacuation position.

[First Tilt Correction Processing]

In response to a print request, the conveyance control portion 8*a* causes the sheet conveying device 3 to convey the sheet 9. When the sheet 9 is being conveyed by the sheet conveying device 3, the conveyance control portion 8*a* and the image processing portion 8*c* execute first tilt correction processing.

For example, upon generation of the print request, the conveyance control portion 8*a* and the image processing portion 8*c* execute the first tilt correction processing in parallel with the print processing. For example, the conveyance control portion 8*a* and the image processing portion 8*c* execute the first tilt correction processing every time one sheet 9 or a plurality of sheets 9 is/are conveyed.

Alternatively, upon generation of the print request, the conveyance control portion 8*a* and the image processing portion 8*c* may execute the first tilt correction processing before the print processing is executed.

Figure 6:
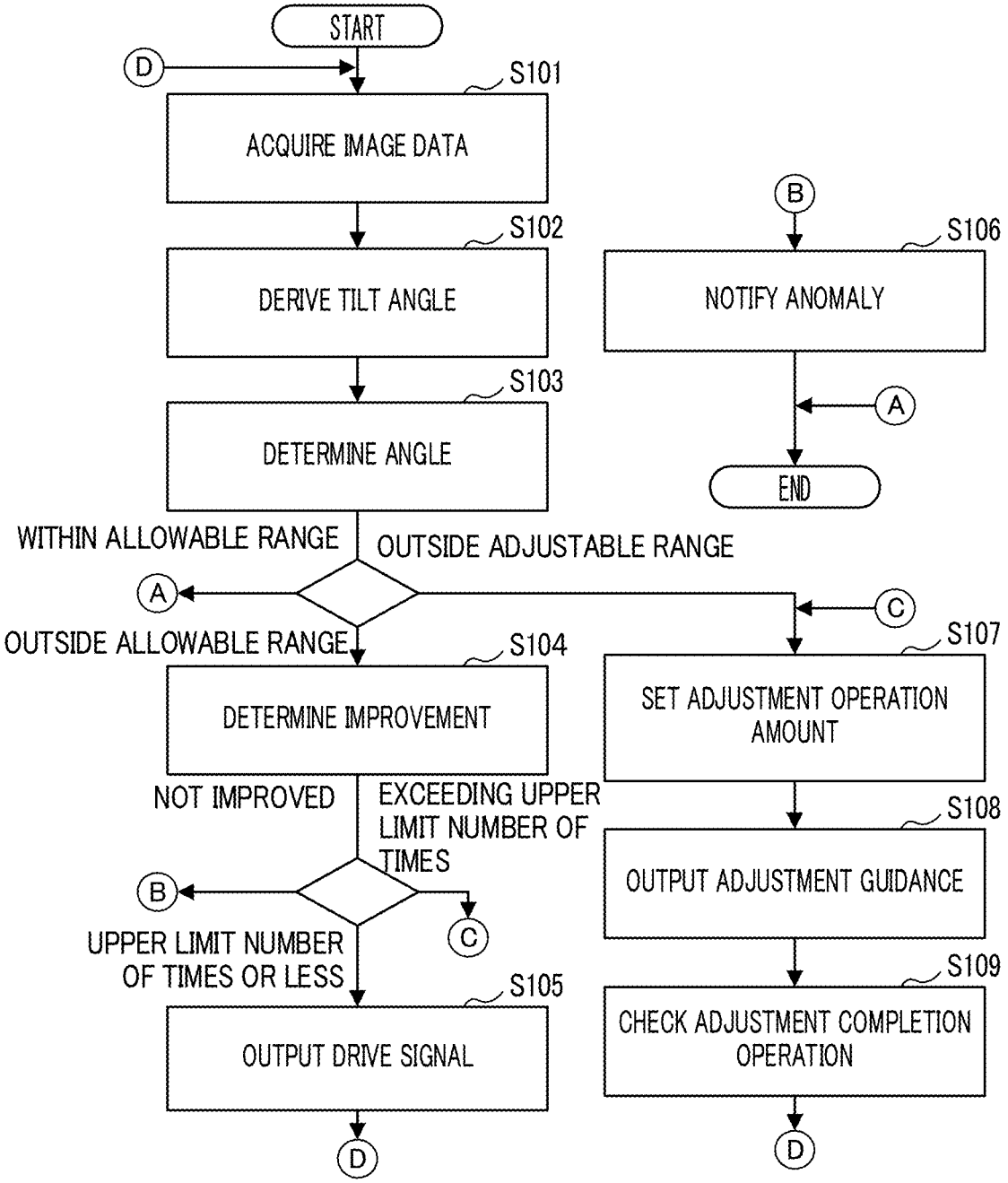
FIG. 6 is a flowchart showing exemplary procedures of first tilt correction processing executed in the image forming apparatus according to the embodiment of the present disclosure.

Hereinafter, exemplary procedures of the first tilt correction processing will be described with reference to the flowchart shown in FIG. 6.

In descriptions below, S101, S102, . . . represent identification symbols of a plurality of steps in the first tilt correction processing. In the first tilt correction processing, processing of Step S101 is executed first.

<Step S101>

In Step S101, the image processing portion 8*c* acquires image data X10 obtained by the operation of the line sensor 6.

For example, the plurality of pieces of line image data LD1 sequentially obtained by the operation of the line sensor 6 are stored in the RAM 81, and the image processing portion 8*c* acquires the image data X10 constituted of the plurality of pieces of line image data LD1 stored in the RAM 81.

After executing the processing of Step S101, the image processing portion 8*c* executes processing of Step S102.

<Step S102>

In Step S102, the image processing portion 8*c* extracts a sheet outer shape image X11 from the image data X10 obtained in Step S101, and derives a tilt angle θ1 of the sheet 9 based on the sheet outer shape image X11.

For example, the image processing portion 8*c* extracts, from the image data X10, an area occupied by a plurality of pieces of pixel data exceeding a reference value as a sheet area, and extracts an image of an outline of the sheet area as the sheet outer shape image X11.

The X coordinate in the image data X10 corresponds to a position on the upper surface of the conveying belt 320 in the second direction D2. The Y coordinate in the image data X10 corresponds to a position on the upper surface of the conveying belt 320 in the first direction D1.

For example, the image processing portion 8*c* specifies coordinates of a first side end point Px1 and a second side end point Px2, which are end points of the sheet outer shape image X11 in an X axis direction at two points spaced apart from each other in a Y axis direction in the image data X10 (see FIG. 7).

Further, the image processing portion 8*c* derives an angle formed between a straight line that passes through the first side end point Px1 and the second side end point Px2 and the Y axis direction as the tilt angle θ1 of the sheet 9.

It is noted that the image processing portion 8*c* may alternatively specify coordinates of a first tip end point and a second tip end point, which are end points of the sheet outer shape image X11 in the Y axis direction at two points spaced apart from each other in the X axis direction in the image data X10. In this case, the image processing portion 8*c* derives an angle formed between a straight line that passes through the first tip end point and the second tip end point and the X axis direction as the tilt angle θ1.

After executing the processing of Step S102, the image processing portion 8*c* executes processing of Step S103.

<Step S103>

In Step S103, the image processing portion 8*c* executes angle determination processing for determining a state of the derived tilt angle 1.

Specifically, in Step S103, the image processing portion 8*c* determines whether or not the tilt angle θ1 is outside an adjustable range. The adjustable range is a range in which the angle of the contact surface 71*a* of the correction member 71 can be changed by the first orientation adjustment mechanism 72.

When determining that the tilt angle θ1 is outside the adjustable range, the image processing portion 8*c* executes processing of Step S107.

When determining in Step S103 that the tilt angle θ1 is not outside the adjustable range, the image processing portion 8*c* determines whether or not the tilt angle 61 is within an allowable range or outside the allowable range. The allowable range is a range narrower than the adjustable range.

When determining that the tilt angle θ1 is within the allowable range, the image processing portion 8*c* ends the first tilt correction processing. On the other hand, when determining that the tilt angle θ1 is outside the allowable range, the conveyance control portion 8*a* executes processing of Step S104.

<Step S104>

In Step S104, the conveyance control portion 8*a* executes improvement determination processing. The improvement determination processing is processing of determining whether or not the tilt angle θ1 has been improved by the operation of the first orientation adjustment mechanism 72.

In Step S105 to be described later, the conveyance control portion 8*a* causes the first orientation adjustment mechanism 72 to operate. For example, the improvement determination processing is processing of determining the number of times the processing of Step S105 has been executed, a change of the tilt angle θ1 before and after the processing of Step S105 is executed, and whether or not the tilt angle θ1 has been improved.

Herein, a predetermined number of times the processing of Step S105 has been executed will be referred to as a reference number of times, the tilt angle θ1 obtained before the processing of Step S105 is executed for the first time will be referred to as a first tilt angle, and the tilt angle θ1 obtained after the processing of Step S105 is executed the reference number of times will be referred to as a second tilt angle.

The conveyance control portion 8*a* determines that the tilt angle θ1 has not been improved when the number of times the processing of Step S105 has been executed has reached the reference number of times and a difference between the first tilt angle and the second tilt angle falls below a reference angular difference.

A situation where the tilt angle θ1 is determined as not having been improved is a state where it is highly likely that an anomaly has occurred in the tilt correction mechanism 7.

Meanwhile, the conveyance control portion 8*a* determines that the tilt angle 61 has been improved when the difference between the first tilt angle and the second tilt angle exceeds the reference angular difference before the number of times the processing of Step S105 has been executed reaches the reference number of times.

When determining that the tilt angle θ1 has not been improved, the conveyance control portion 8*a* executes processing of Step S106.

Furthermore, when it is determined that the tilt angle θ1 has been improved and the number of times the processing of Step S105 has been executed falls below an upper limit number of times, the conveyance control portion 8*a* executes the processing of Step S105.

On the other hand, when it is determined that the tilt angle θ1 has been improved and the number of times the processing of Step S105 has been executed has reached the upper limit number of times, the conveyance control portion 8*a* executes the processing of Step S107.

A situation where the tilt angle θ1 does not fall within the allowable range until the number of times the processing of Step S105 has been executed reaches the upper limit number of times is an example of a situation where the correction of the tilt of the sheet 9 by the first orientation adjustment mechanism 72 and the processing of Step S105 has reached a limit of a correctable range.

It is noted that when the processing of Step S105 has not been executed yet, the conveyance control portion 8*a* skips the processing of Step S104 and executes the processing of Step S105.

<Step S105>

In Step S105, the conveyance control portion 8*a* outputs the drive signal corresponding to the tilt angle θ1 to the first orientation adjustment mechanism 72. Specifically, the conveyance control portion 8*a* outputs the drive signal that causes the angle of the contact surface 71*a* to change in an opposite direction from the tilt angle θ1.

For example, the conveyance control portion 8*a* applies the tilt angle θ1 to preset first conversion table data to derive an adjustment angle of the contact surface 71*a*. In addition, the conveyance control portion 8*a* outputs the drive signal corresponding to a direction and magnitude of the adjustment angle.

It is noted that the conveyance control portion 8*a* that executes the processing of Step S105 is an example of an adjustment processing portion.

When the sheet 9 is newly conveyed after the conveyance control portion 8*a* executes the processing of Step S105, the image processing portion 8*c* and the conveyance control portion 8*a* execute the processing of Step S101 and the subsequent steps again.

<Step S106>

Meanwhile, in Step S106, the conveyance control portion 8*a* outputs, via one or both of the display device 802 and the communication device 84, an anomaly notification that notifies that there is a possibility of an anomaly in the tilt correction mechanism 7.

After executing the processing of Step S106, the conveyance control portion 8*a* ends the first tilt correction processing.

The processing of Step S107 to Step S109 described below is executed when the derived result of the tilt angle θ1 is outside the allowable range under the situation where the correction of the tilt of the sheet 9 by the first orientation adjustment mechanism 72 and the processing of Step S105 has reached the limit of the correctable range (see Step S103 and Step S104). In the present embodiment, the processing of Step S107 to Step S109 is also executed when the tilt angle θ1 is outside the range in which the angle of the contact surface 71*a* can be changed by the first orientation adjustment mechanism 72 (see Step S103).

<Step S107>

In Step S107, the conveyance control portion 8*a* sets an adjustment operation amount with respect to the second orientation adjustment mechanism 74 based on the latest derived result of the tilt angle θ1.

In the present embodiment, the adjustment operation amount is a direction in which the screw member 742 is turned and an amount by which the screw member 742 is turned.

For example, the conveyance control portion 8*a* applies the tilt angle θ1 to preset second conversion table data to derive the adjustment operation amount.

The conveyance control portion 8*a* that executes the processing of Step S107 is an example of an operation amount setting portion that sets the adjustment operation amount.

After executing the processing of Step S107, the conveyance control portion 8*a* executes the processing of Step S108.

<Step S108>

In Step S108, the conveyance control portion 8*a* outputs adjustment guidance information that prompts the adjustment by the second orientation adjustment mechanism 74 via one or both of the display device 802 and the communication device 84.

In the present embodiment, the conveyance control portion 8*a* outputs the adjustment guidance information including information on the adjustment operation amount set in Step S107.

Figure 5:
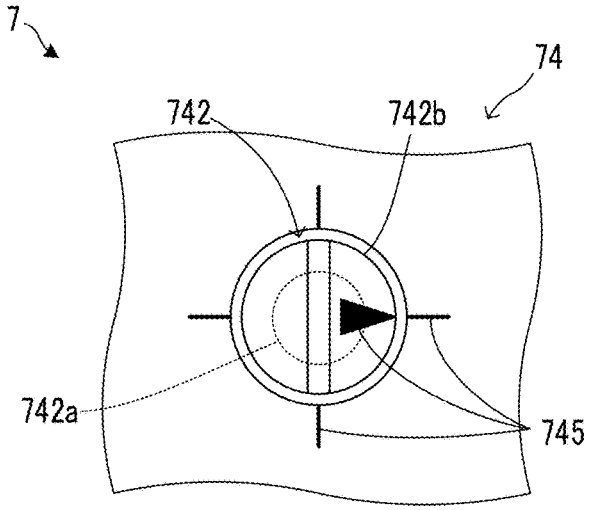
FIG. 5 is a diagram showing an adjustment screw and an adjustment scale in the image forming apparatus according to the embodiment of the present disclosure.

As shown in FIG. 5, the second orientation adjustment mechanism 74 includes adjustment scale marks 745 each as an indication of a position of the screw member 742 in the rotational direction. An operator can turn the screw member 742 while checking the adjustment scale marks 745, to thus easily turn the screw member 742 only by the adjustment operation amount.

The display device 802 and the communication device 84 are each an example of an information output device. The conveyance control portion 8*a* that executes the processing of Step S108 is an example of a notification processing portion that outputs the adjustment guidance information via the information output device.

After executing the processing of Step S108, the conveyance control portion 8*a* executes the processing of Step S109.

<Step S109>

In Step S109, the conveyance control portion 8*a* checks whether or not an adjustment completion operation with respect to the operation device 801 has been made. The adjustment completion operation is an operation that indicates that the adjustment of the orientation of the support member 73 by the second orientation adjustment mechanism 74 has been completed.

The conveyance control portion 8*a* waits until the adjustment completion operation with respect to the operation device 801 is made. When the adjustment completion operation with respect to the operation device 801 is made, the conveyance control portion 8*a* shifts the processing to Step S101. Thus, when the sheet 9 is newly conveyed, the image processing portion 8*c* and the conveyance control portion 8*a* execute the processing of Step S101 and the subsequent steps again.

[Second Tilt Correction Processing]

In the present embodiment, the conveyance control portion 8*a* and the image processing portion 8*c* execute second tilt correction processing as processing for an initial adjustment of the image forming apparatus 10.

The conveyance control portion 8*a* and the image processing portion 8*c* execute the second tilt correction processing when the sheet 9 is being conveyed by the sheet conveying device 3.

For example, when a predetermined adjustment start operation is made, the conveyance control portion 8*a* causes the sheet conveying device 3 to convey the sheet 9, and the conveyance control portion 8*a* and the image processing portion 8*c* execute the second tilt correction processing. The conveyance control portion 8*a* and the image processing portion 8*c* execute the second tilt correction processing under a situation where the print processing is not executed.

Figure 8:
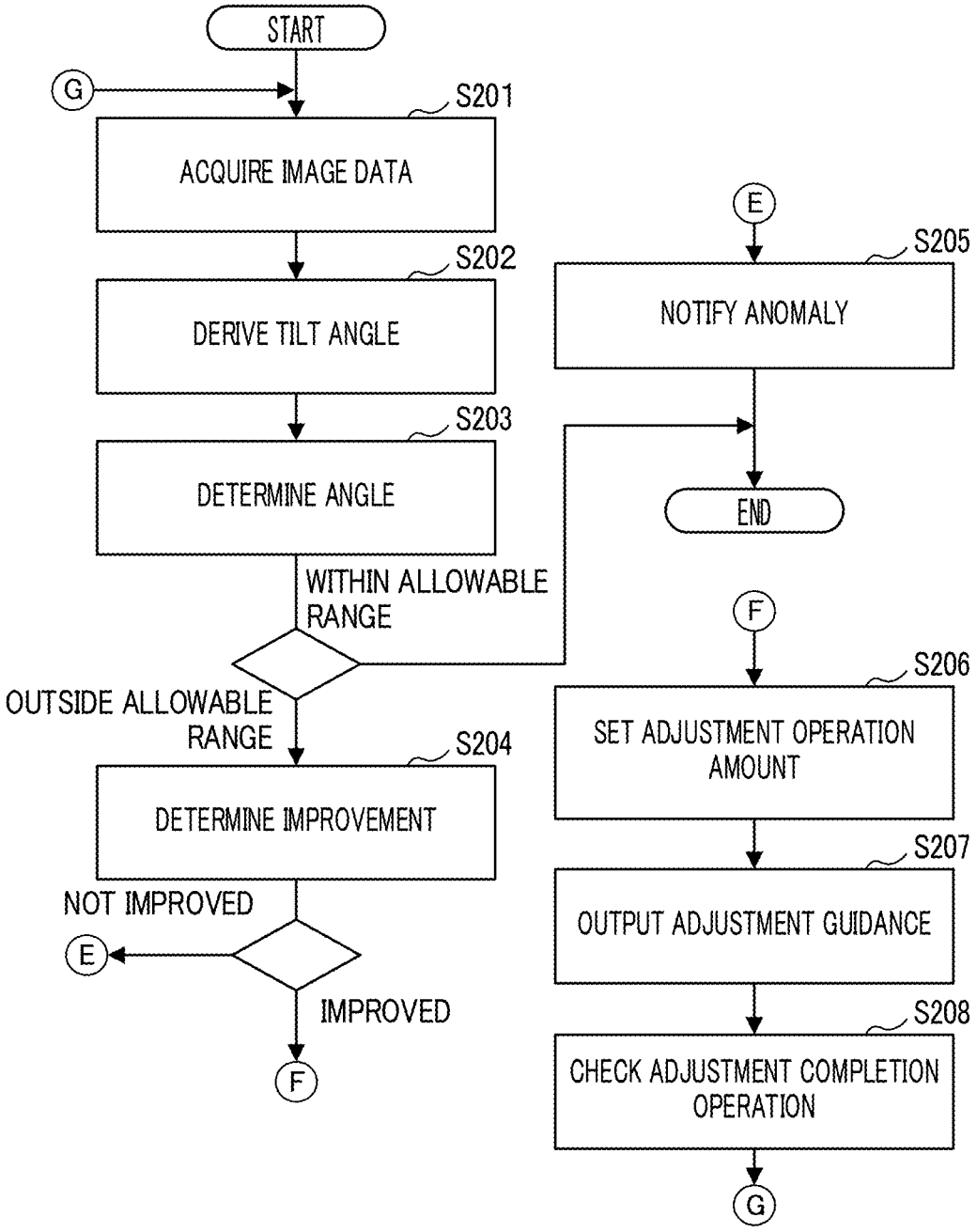
FIG. 8 is a flowchart showing exemplary procedures of second tilt correction processing executed in the image forming apparatus according to the embodiment of the present disclosure.

Hereinafter, exemplary procedures of the second tilt correction processing will be described with reference to the flowchart shown in FIG. 8.

In descriptions below, S201, S202, . . . represent identification symbols of a plurality of steps in the second tilt correction processing. In the second tilt correction processing, processing of Step S201 is executed first.

Before the processing of step S201 is executed, the conveyance control portion 8*a* outputs the drive signal to the first orientation adjustment mechanism 72 to retain the correction member 71 at a predetermined initial position. When the correction member 71 is positioned at the initial position, the contact surface 71*a* forms a predetermined reference angle with respect to the first direction D1. For example, the reference angle is 0 degrees.

After the correction member 71 at the initial position is retaind, the image processing portion 8*c* executes processing of Step S201.

<Step S201>

In Step S201, similar to Step S101 in the first tilt correction processing, the image processing portion 8*c* acquires image data X10 obtained by the operation of the line sensor 6.

After executing the processing of Step S201, the image processing portion 8*c* executes processing of Step S202.

<Step S202>

In Step S202, the image processing portion 8*c* extracts a sheet outer shape image X11 from the image data X10 acquired in Step S201, and derives the tilt angle 61 of the sheet 9 based on the sheet outer shape image X11. The processing of Step S202 is similar to the processing of Step S102 in the first tilt correction processing.

After executing the processing of Step S202, the image processing portion 8*c* executes processing of Step S203.

<Step S203>

In Step S203, similar to Step S103 in the first tilt correction processing, the image processing portion 8*c* executes the angle determination processing for determining the state of the tilt angle θ1.

That is, the image processing portion 8*c* determines whether or not the tilt angle θ1 is within the allowable range or is outside the allowable range. It is noted that in Step S203, the processing of determining whether or not the tilt angle θ1 is outside the adjustable range may be omitted.

When the tilt angle θ1 is within the allowable range, the image processing portion 8*c* ends the second tilt correction processing. On the other hand, when the tilt angle θ1 is outside the allowable range, the conveyance control portion 8*a* executes processing of Step S204.

<Step S204>

In Step S204, similar to Step S104 in the first tilt correction processing, the conveyance control portion 8*a* executes the improvement determination processing.

It is noted that the second tilt correction processing does not include the processing of Step S105 in the first tilt correction processing. Therefore, in Step S204, the processing of comparing the number of times the processing of Step S105 has been executed with the upper limit number of times is omitted.

When determining that the tilt angle θ1 has not been improved, the conveyance control portion 8*a* executes processing of Step S205.

On the other hand, when determining that the tilt angle θ1 has been improved, the conveyance control portion 8*a* executes processing of Step S206.

<Step S205>

Meanwhile, in Step S205, similar to Step S106 in the first tilt correction processing, the conveyance control portion 8*a* outputs the anomaly notification via one or both of the display device 802 and the communication device 84.

After executing the processing of Step S205, the conveyance control portion 8*a* ends the second tilt correction processing.

<Step S206>

In Step S206, the conveyance control portion 8*a* sets the adjustment operation amount with respect to the second orientation adjustment mechanism 74 based on the latest derived result of the tilt angle θ1. The processing of Step S206 is similar to the processing of Step S107 in the first tilt correction processing.

After executing the processing of Step S206, the conveyance control portion 8*a* executes processing of Step S207.

<Step S207>

In Step S207, the conveyance control portion 8*a* outputs the adjustment guidance information via one or both of the display device 802 and the communication device 84. The processing of Step S207 is similar to the processing of Step S108 in the first tilt correction processing.

After executing the processing of Step S207, the conveyance control portion 8*a* executes processing of Step S208.

<Step S208>

In Step S208, similar to Step S109 in the first tilt correction processing, the conveyance control portion 8*a* checks whether or not the adjustment completion operation with respect to the operation device 801 has been made.

The conveyance control portion 8*a* waits until the adjustment completion operation with respect to the operation device 801 is made. When the adjustment completion operation with respect to the operation device 801 is made, the conveyance control portion 8*a* shifts the processing to Step S201. Thus, when the sheet 9 is newly conveyed, the conveyance control portion 8*a* and the image processing portion 8*c* execute the processing of Step S201 and the subsequent steps again.

By adopting the tilt correction mechanism 7, the tilt of the conveyed sheet 9 can be corrected with a simple mechanism.

Further, in the tilt correction mechanism 7, the second orientation adjustment mechanism 74 is capable of performing a rough tilt adjustment of the contact surface 71*a* according to a large difference in characteristics of the sheets 9, and the first orientation adjustment mechanism 72 is capable of performing a highly-precise tilt adjustment of the contact surface 71*a* according to variations in the characteristics of the sheets 9. Accordingly, the tilt correction mechanism 7 can cope with a variety of characteristics of the sheets 9.

Notes of Disclosure

Hereinafter, a general outline of the invention extracted from the embodiment described above will be noted. It is noted that the respective configurations and processing functions described in the notes below can be sorted and arbitrarily combined as appropriate.

Note 1

A sheet conveying device, including:

a first conveying mechanism which conveys a sheet;

a correction member which is provided more on an upstream side of a conveying direction of the sheet by the first conveying mechanism than the first conveying mechanism, and includes a contact surface that comes into contact with a side end of the sheet at one end of a conveying path of the sheet in a width direction orthogonal to the conveying direction;

a first orientation adjustment mechanism which is operated by being input with a drive signal and changes an angle of the contact surface with respect to the conveying direction;

a second conveying mechanism which is provided more on the upstream side of the conveying direction than the correction member, and conveys the sheet toward the contact surface along a direction that is oblique with respect to the conveying direction;

a support member which supports the correction member and the first orientation adjustment mechanism; and a second orientation adjustment mechanism which is capable of changing an orientation of the support member with respect to the conveying direction by being operated manually.

Note 2

The sheet conveying device according to note 1, in which the first orientation adjustment mechanism is a mechanism which causes the correction member to rotate about a first shaft portion, and the second orientation adjustment mechanism is a mechanism which causes the support member to rotate about a second shaft portion arranged coaxially with the first shaft portion.

Note 3

The sheet conveying device according to note 1 or 2, in which the second orientation adjustment mechanism includes a base portion formed with a screw hole and a screw member fastened to the screw hole, and by the manual operation of the screw member, a fastening depth of the screw member with respect to the screw hole changes, and also the orientation of the support member changes.

Note 4

The sheet conveying device according to any one of notes 1 to 3, in which the first conveying mechanism conveys, by a conveying belt which rotates, the sheet delivered onto the conveying belt.

Note 5

An image forming apparatus, including:

the sheet conveying device according to any one of notes 1 to 4;

an image forming portion which forms an image on the sheet conveyed by the first conveying mechanism;

an image reading device which reads an outer shape of the sheet conveyed by the sheet conveying device;

an image processing portion which derives, based on a read image obtained by the image reading device, a tilt angle of the sheet with respect to the conveying direction; and an adjustment processing portion which outputs the drive signal to the first orientation adjustment mechanism based on a derived result of the tilt angle.

Note 6

The image forming apparatus according to note 5, including:

a notification processing portion which outputs, when the derived result of the tilt angle is outside an allowable range under a situation where a tilt correction of the sheet by the first orientation adjustment mechanism and processing of the adjustment processing portion has reached a limit of a correctable range, adjustment guidance information for prompting an adjustment by the second orientation adjustment mechanism via an information output device.

Note 7

The image forming apparatus according to note 6, including:

an operation amount setting portion which sets, based on the derived result of the tilt angle obtained under the situation where the tilt correction of the sheet by the first orientation adjustment mechanism and the processing of the adjustment processing portion has reached the limit of the correctable range, an adjustment operation amount with respect to the second orientation adjustment mechanism, in which the notification processing portion outputs the adjustment guidance information including information on the adjustment operation amount.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device, comprising:

a first conveying mechanism which conveys a sheet;

a correction member which is provided more on an upstream side of a conveying direction of the sheet by the first conveying mechanism than the first conveying mechanism, and includes a contact surface that comes into contact with a side end of the sheet at one end of a conveying path of the sheet in a width direction orthogonal to the conveying direction;

a first orientation adjustment mechanism which is operated by being input with a drive signal and changes an angle of the contact surface with respect to the conveying direction;

a second conveying mechanism which is provided more on the upstream side of the conveying direction than the correction member, and conveys the sheet toward the contact surface along a direction that is oblique with respect to the conveying direction;

a support member which supports the correction member and the first orientation adjustment mechanism; and a second orientation adjustment mechanism which is capable of changing an orientation of the support member with respect to the conveying direction by being operated manually.

2. The sheet conveying device according to claim 1, wherein the first orientation adjustment mechanism is a mechanism which causes the correction member to rotate about a first shaft portion, and the second orientation adjustment mechanism is a mechanism which causes the support member to rotate about a second shaft portion arranged coaxially with the first shaft portion.

3. The sheet conveying device according to claim 1, wherein the second orientation adjustment mechanism includes a base portion formed with a screw hole and a screw member fastened to the screw hole, and by the manual operation of the screw member, a fastening depth of the screw member with respect to the screw hole changes, and also the orientation of the support member changes.

4. The sheet conveying device according to claim 1, wherein the first conveying mechanism conveys, by a conveying belt which rotates, the sheet delivered onto the conveying belt.

5. An image forming apparatus, comprising:

the sheet conveying device according to claim 1;

an image forming portion which forms an image on the sheet conveyed by the first conveying mechanism;

an image reading device which reads an outer shape of the sheet conveyed by the sheet conveying device;

an image processing portion which derives, based on a read image obtained by the image reading device, a tilt angle of the sheet with respect to the conveying direction; and an adjustment processing portion which outputs the drive signal to the first orientation adjustment mechanism based on a derived result of the tilt angle.

6. The image forming apparatus according to claim 5, comprising:

a notification processing portion which outputs, when the derived result of the tilt angle is outside an allowable range under a situation where a tilt correction of the sheet by the first orientation adjustment mechanism and processing of the adjustment processing portion has reached a limit of a correctable range, adjustment guidance information for prompting an adjustment by the second orientation adjustment mechanism via an information output device.

7. The image forming apparatus according to claim 6, comprising:

an operation amount setting portion which sets, based on the derived result of the tilt angle obtained under the situation where the tilt correction of the sheet by the first orientation adjustment mechanism and the processing of the adjustment processing portion has reached the limit of the correctable range, an adjustment operation amount with respect to the second orientation adjustment mechanism, wherein the notification processing portion outputs the adjustment guidance information including information on the adjustment operation amount.

* * * * *